United States Patent [19]

Craig et al.

[11] 3,966,431

[45] June 29, 1976

[54] WASTE STONE OXIDATION AND RECARBONIZATION

[75] Inventors: John W. T. Craig, E. Hendred near Wantage, England; Eoin P. O'Neill; Dale L. Keairns, both of Pittsburgh, Pa.

[73] Assignee: The United States of America as represented by the United States Environmental Protection Agency, Washington, D.C.

[22] Filed: Feb. 21, 1975

[21] Appl. No.: 551,786

[52] U.S. Cl. ..... 48/197 R; 48/212; 48/213; 48/215; 110/1 J; 122/4 D; 423/232; 423/244; 423/431; 423/555

[51] Int. Cl.[2] ..... C10J 1/00; C10K 1/34

[58] Field of Search ..... 423/244, 232, 431, 555; 48/211, 212, 213, 215, 197 R; 252/455 R; 110/28 J, 1 J; 122/4 D

[56] References Cited

UNITED STATES PATENTS

| | | | |
|---|---|---|---|
| 3,540,387 | 11/1970 | McLaren et al. | 110/1 J |
| 3,661,800 | 5/1972 | Pfeiffer et al. | 252/417 |
| 3,783,528 | 1/1974 | Sheely | 23/288 S |
| 3,807,090 | 4/1974 | Moss | 48/211 |

*Primary Examiner*—S. Leon Bashore
*Assistant Examiner*—George C. Yeung

[57] ABSTRACT

The disclosed process provides for the production of a desulfurized fuel gas from a sulfur-containing fuel oil by absorption, in a first reaction zone, of the sulfur contaminants with a calcium oxide-containing material, which material is then further treated to render it environmentally stable without producing a sulfur-rich gas process stream. The spent limestone from the oil gasifier is reacted with an oxygen-containing gas in a second reaction zone for conversion of the calcium sulfide to calcium sulfate and the sulfated material is then transferred to a third reaction zone wherein it is reacted with carbon dioxide for conversion of the calcium oxide to calcium carbonate.

5 Claims, 1 Drawing Figure

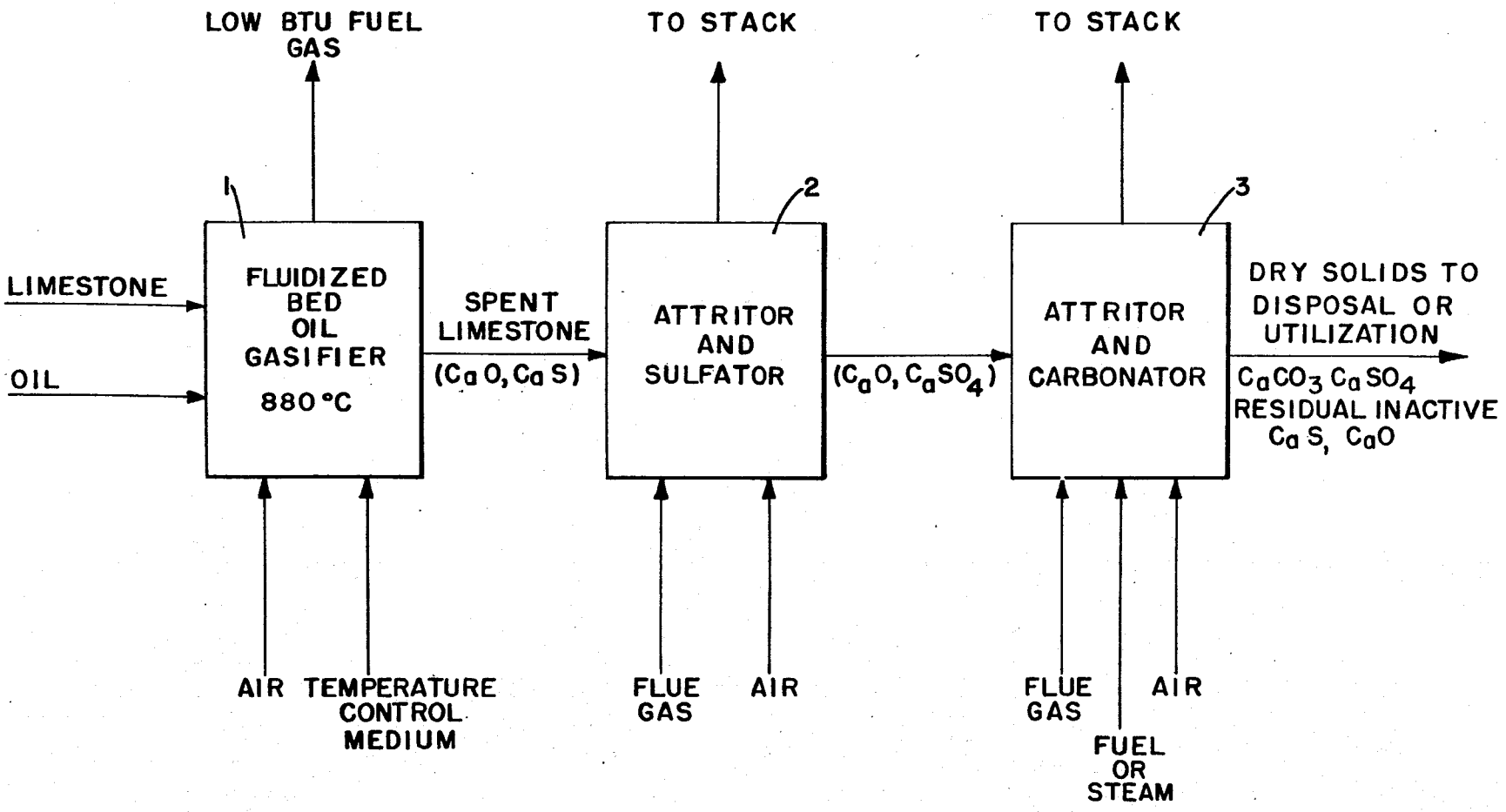
LIMESTONE
OIL
1
FLUIDIZED BED OIL GASIFIER 880 °C
LOW BTU FUEL GAS
AIR
TEMPERATURE CONTROL MEDIUM
SPENT LIMESTONE
(CaO, CaS)
2
ATTRITOR AND SULFATOR
TO STACK
FLUE GAS
AIR
(CaO, CaSO4)
3
ATTRITOR AND CARBONATOR
TO STACK
FLUE GAS
FUEL OR STEAM
AIR
DRY SOLIDS TO DISPOSAL OR UTILIZATION
CaCO3 CaSO4
RESIDUAL INACTIVE
CaS, CaO

WASTE STONE OXIDATION AND RECARBONIZATION

BACKGROUND OF THE INVENTION

In the "Chemically Active Fluid Bed" gasification process (CAFB) petroleum oil feed stock is converted into a hot combustible fuel gas. The hot fuel gas contains sulfur, predominantly in the form of hydrogen sulfide. In order to prevent environmental pollution by the combustion products of this gas, the sulfur content of the gas must be reduced to acceptable levels by desulfurization either before or after combustion, i.e., either by removing the $H_2S$ from the fuel or by removing $SO_2$ from the combustion gas.

British Pat. No. 1,183,937 describes a typical process for the removal of sulfur contaminates from such a gas. It describes a process in which a hot fluidized bed of calcium oxide (generated from limestone heated in situ) is employed to absorb the sulfur contaminants as calcium sulfide. The process may be operated regeneratively or nonregeneratively. In the regenerative embodiment described in the British patent, the fluidized bed material is regenerated by heating to about 1000°C in a mildly reducing atmosphere to remove sulfur oxides and the regenerated calcium oxide is returned to the absorption vessel. Similar processes are described in U.S. Pat. Nos. 3,402,998; 3,599,610; 3,625,164; 3,707,462; 3,717,700; and 3,781,408.

Even in those processes in which the lime is regenerated and reused in the desulfurization step, it is necessary to continuously or periodically remove a portion of the lime reactant and replace that portion with fresh lime (usually added in the form of limestone, which calcined in situ) in order to maintain the desired level of reagent activity. A typical spent lime material from such a desulfurization process will contain approximately 95% by weight CaO, 4% by weight CaS and $CaSO_4$ and 0.8% by weight Vanadium. The spent lime removed from the system will react vigorously with carbon dioxide and water to release heat and hydrogen sulfide, rendering it a fire hazard and threat to animal life. Consequently, further treatment of the spent lime is necessary in order to render it environmentally acceptable and safe for general disposal.

Several proposals have been set forth for the recovery of by-products by the conversion of the sulfur dioxide in the regenerator exit gas to sulfuric acid or sulfur and for the treatment of the spent lime for conversion to some environmentally acceptable form. However, all of these suggested methods require two separate processes, one for treatment of the sulfur dioxide containing gas and a separate treatment for the spent lime. British Pat. No. 1,183,937 (page 2, lines 89–111), U.S. Pat. No. 3,707,462 (col. 3, lines 1–4), and U.S. Pat. No. 3,717,700 (col. 5, lines 63 to col. 6, line 7), all suggest the catalytic conversion of the sulfur dioxide from the regenerator to some useful by-product.

A process for the removal of sulfur values from a flue gas, and subsequent conversion to a construction material, is disclosed by Lin in U.S. Pat. No. 3,781,408. Lin passes flue gases from a combustion chamber containing sulfur dioxide through a catalytic oxidation converter to convert the sulfur dioxide to sulfur trioxide. Sulfur trioxide is then passed through an absorber having staged fluidized beds of lime to form calcium sulfate. The result is a mixture of calcium sulfate and calcium oxide which may be blended with fly ash and used as a construction material. The Lin process does not produce an environmentally stable product and its economic hinge on the market for the construction material which it produces.

U.S. Pat. No. 3,402,998, issued to Squires, describes a process wherein a hot fuel gas is reacted with calcined dolomite to absorb the hydrogen sulfide contained therein. The sulfurized calcined dolomite is then reacted with steam and carbon dioxide to produce a hydrogen sulfide-rich overhead which is treated in a separate process for the recovery of sulfur by-products. Squires teaches that the solids from the carbonization step may be calcined and reused in the fuel-desulfurization step.

SUMMARY OF THE INVENTION

It has now been discovered that the calcium sulfide-containing lime material from the gasifier of a standard desulfurizing oil gasification process can be subjected to successive sulfation and carbonation treatments in separate reaction zones to produce a single environmentally stable dry product suitable for general disposal. The present process offers the distinct advantage that the successive sulfation and carbonation treatments do not result in a gaseous process stream which requires further treatment for sulfur removal. The process of the present invention involves transferring the spent lime, containing some amount of calcium sulfide, from the fluidized bed oil gasifier to a second reaction zone wherein it is reacted with an oxygen-containing gas to convert the major portion of the calcium sulfide to calcium sulfate. The sulfated spent lime is then transferred to a third reaction zone wherein it is further reacted with carbon dioxide to convert a major portion of the calcium oxide contained therein to calcium carbonate. The dry solid product obtained from the third reaction zone consists mainly of calcium carbonate and calcium sulfate and the residual calcium oxide and calcium sulfide is covered with successive layers of calcium sulfate and calcium carbonate and is therefore environmentally stable.

Accordingly, it is an object of the present invention to provide a process whereby the sulfide-containing spent lime from a fluidized bed oil gasifier can be treated to produce an environmentally stable dry product without the generation of a sulfur containing gas stream requiring further treatment.

It is a further object of the present invention to provide a by-product in dry form which is environmentally stable, and which, when cooled, can be disposed of without further treatment.

These and other objects of the present invention will become more apparent from a reading of the following description taken in conjunction with the accompanying drawing and appended claims.

BRIEF DESCRIPTION OF THE DRAWING

The sole drawing is a schematic representation of one embodiment of the process of the present invention.

DESCRIPTION OF THE PREFERRED EMBODIMENTS

The drawing illustrates one embodiment of the process of the present invention wherein a fluid fuel feed (petroleum oil) and crushed limestone are fed into a first reaction zone or gasifier 1 wherein the limestone is calcined to form particulate calcium oxide in situ and the calcium oxide is fluidized and heated by means of a mixture of air and steam injected into the bottom of the vessel 1. The fluidized bed within the vessel 1 is maintained at a temperature of about 870°C and operates at a pressure of about 1.25 atmospheres. As the fuel feed passes through the gasifier 1, it is cracked and/or gasified and the sulfur contaminants contained therein, principally hydrogen sulfide, react with the calcium oxide to form calcium sulfide-containing coatings on the calcium oxide particles. The reaction between hydrogen sulfide and calcium oxide, within the gasifier 1, is as follows:

$$CaO + H_2S \rightarrow CaS + H_2O \qquad 1.$$

The temperature of the fluidized bed within the gasifier or first reaction zone is suitably within the range of 820°–920°C, and preferably about 870°C. Temperature control within the gasifier may be achieved by any one of or combination of techniques, i.e., by injecting a temperature control medium such as steam into the bed, by controlling the amount of the air feed to the bed (and accordingly, the amount of combustion within the bed), and/or by controlling the amount of flue gas from the third reaction zone of the $SO_2$ absorber recycled to the gasifier. Typically, about 1/5 of the total oil feed to the gasifier is combusted therein, and the remainder is cracked and/or gasified.

The calcium sulfide-coated particles are transferred from the gasifier 1 to a second reaction zone or sulfator 2 wherein they are fluidized by a mixture of air and flue gas for reaction with oxygen in accordance with the following equation:

$$CaS + 2O_2 \rightarrow CaSO_4 \qquad 2.$$

The flue gas serves to dilute the air, thereby controlling the temperature rise occasioned in the fluidized bed of the second reaction zone by the exothermic nature of reaction 2 to maintain the temperature within a suitable range, i.e., 820°–920°C and, preferably, below 850°C to minimize the loss of sulfur as $SO_2$. Other conventional means for temperature control may also be employed if desired, such as steam. Some recarbonization of calcium oxide occurs within the sulfator 2 by reaction with the carbon dioxide component of the flue gas.

The feed to the second reaction zone, or sulfator 2, is through a jet attritor, which causes the particles (typically 300–3000 microns in diameter) to impinge on a plate, causing them to break, and reducing them to a particle size as fine as 40 microns. Alternative methods of attrition may be utilized, either external or internal, to achieve the desired particle size. The residence time for the solids within the sulfator is about 32 minutes. At least 80% by weight, and as much as 90–95%, of the sulfide is converted to sulfate in the second reaction zone. The gaseous overhead from the sulfator will contain less than 50 ppm $SO_2$ and no detectable $H_2S$.

The sulfated spent lime from the sulfator 2 is transferred to third reaction zone or carbonator 3 wherein it is fluidized by a mixture of air, flue gas, and fuel or steam for reaction with the carbon dioxide component of the flue gas in accordance with the following equation:

$$CaO + CO_2 \xrightarrow{steam} CaCO_3 \qquad 3.$$

The flow rates of fuel, air, and steam are controlled to maintain the temperature of the fluidized bed within the carbonator 3 at 710°–770°C and preferably about 750°C. Conversions of more than 70% of CaO to $CaCO_3$ have been achieved in the carbonator with solids residence times of 30 minutes or more.

Further attrition of the calcium oxide particulate material fed to the carbonator 3 may be achieved by means of a jet attritor, as used in the sulfator. Optionally, internal or external attrition or grinding may be used to achieve the desired particle size.

The sulfation and carbonization reactions are conducted in separate reaction zones to avoid conflicting reactions which could result in the presence of significant amounts of sulfur-containing gases in the overheads from these reactions.

The off-gas streams from the sulfator and/or carbonator may be vented directly to the atmosphere without violating emission standards. If desired, one or both off-gas streams may be recycled to the gasifier.

The three reaction zones are conveniently operated at near atmospheric pressure, i.e., about 1.25 atmospheres; however, elevated pressures and pressurized vessels may be employed if desired.

The sulfur acceptor used in the gasifier may be any calcium oxide-containing material. Instead of limestone, dolomite may be fed to the gasifier, wherein it will be calcined in situ to form a mixture of magnesium oxide and calcium oxide.

In the preferred embodiment, fluidized beds are employed in all three reaction zones; however, fixed beds or entrained bed reactors may be used as alternatives to the fluidized bed units described. Likewise, one or more of the reaction zones may be provided with staged beds of the particulate calcium oxide-coating material.

The oxygen-containing gas fed to all or any one of the three reaction zones may be oxygen, air, a mixture thereof, or any other suitable source of gaseous oxygen, but is most conveniently air. Oxygen may be used to enable vessel size reduction.

The invention may be embodied in other specific forms without departing from the spirit or essential characteristics thereof. The present embodiments are therefore to be considered in all respects as illustrative and not restrictive, the scope of the invention being illustrated by the appended claims rather than by the foregoing description, and all changes which come within the meaning and range of equivalency of the claims are therefore intended to be embraced therein.

We claim:

1. A process for the desulfurization and gasification of a sulfur-containing fuel comprising:

contacting said sulfur-containing fuel with a particulate calcium oxide-containing material, in a first reaction zone, at a temperature sufficient to gasify said fuel and to cause the sulfur contained therein to react with the calcium oxide to form calcium sulfide coatings on the particles and to produce a fuel gas overhead of reduced sulfur content;

transferring said calcium sulfide-coated particles from said first reaction zone to a second reaction zone, wherein said particles are contacted with a free oxygen-containing gas at a temperature sufficient to convert at least a portion of said calcium sulfide to calcium sulfate, thereby forming sulfated particles;

transferring said sulfated particles to a third reaction zone wherein said sulfated particles are contacted with a carbon dioxide-containing gas to convert at least a portion of the calcium oxide contained in said sulfated particles into calcium carbonate, thus forming an environmentally stable particulate material comprising calcium sulfate and calcium carbonate.

2. The process of claim 1 wherein said first, second, and third reaction zones contain beds of a particulate calcium oxide containing material fluidized by a fluid selected from a free oxygen-containing gas, flue gases, steam, and mixtures thereof.

3. The process of claim 2 wherein said first zone is maintained at a temperature within the range of 820°–920°C, said second zone is maintained at a temperature below about 850°C, and said third zone is maintained at a temperature within the range of 710°–770°C.

4. The process of claim 2, wherein the average particle size of the calcium oxide-containing material within the first zone is 300–3000 microns and wherein the average particle size is reduced to less than 100 microns by means of jet attrition within said second zone.

5. The process of claim 1 wherein at least one of said zones is provided with staged beds of said particulate calcium oxide-containing material.

* * * * *